United States Patent [19]

Yamaguchi et al.

[11] 4,430,841

[45] Feb. 14, 1984

[54] METHOD OF FILLING A CRACK IN CONCRETE

[75] Inventors: Akihiro Yamaguchi; Masatoshi Ohkura, both of Tokyo, Japan

[73] Assignee: Sho-Bond Construction Co., Ltd., Japan

[21] Appl. No.: 215,633

[22] Filed: Dec. 11, 1980

[30] Foreign Application Priority Data

Nov. 20, 1980 [JP] Japan ..... 55-164293

[51] Int. Cl.[3] ..... E04B 1/00

[52] U.S. Cl. ..... 52/744; 52/514; 138/30; 138/31

[58] Field of Search ..... 52/744, 514; 138/30, 138/31

[56] References Cited

U.S. PATENT DOCUMENTS 2,593,316 4/1952 Kraft ..... 138/31 X 3,168,045 2/1965 Sebastiani ..... 138/31 X

*Primary Examiner*—Carl D. Friedman

*Attorney, Agent, or Firm*—McGlew and Tuttle

[57] ABSTRACT

The pressure to the cracks in the concrete building and the like exerted by a binding material supplied thereinto is buffered by the expansion of a pressure buffering portion located somewhere between the supply pump and the supply pipe and after the supply pump is disconnected, the binding material supplying operation is succeeded by the pressure buffering portion which, having therein reserved the binding material by expansion, forces the binding material out into the cracks by contraction.

2 Claims, 7 Drawing Figures

METHOD OF FILLING A CRACK IN CONCRETE

BACKGROUND OF THE INVENTION

This invention relates to a method and an apparatus for supplying binding materials into the cracks and the like in a concrete building or construction.

The reparation of the concrete building impaired with cracks is usually carried out by filling the cracks with putties or supplying the cracks with binding materials.

A method of repairing cracked buildings by supplying binding materials into the cracks has been recently proposed, whereby pipes are fixed at the cracks with suitable space one from another, said space in the cracks between the pipes being sealed with a sealing material and a pump is connected to each pipe upon hardening of the sealing material to supply a binding material into the cracks (Japanese Pat. No. 251791).

That method, accomplishing the purpose of repairing crack-impaired concrete in its way, suffers from some drawbacks, however, in its operation. Increase in the rate at which a binding material is supplied into the cracks, for example, will cause the elevation of the pressure exerted on the cracks due to the viscosity of the binding material and could result in the sealed portions being ruptured or the cracks widened. It was hence necessary according to that method to spend as much as about 3 to 5 minutes in supplying the binding material using a pipe and skilled persons were required for operation.

SUMMARY OF THE INVENTION

An object of the present invention is to provide an apparatus for supplying binding materials into cracks and the like of buildings or constructions made of concrete, which comprises at a suitable position between a binder supply pipe and a binder supply hose a pressure buffering portion that increases its capacity and reserves the binding material in itself, while the binding material is being supplied into the cracks, and allows the reserved binding material to be forced out into the cracks by contraction after the supply pump has been disconnected and the supply of the binding material discontinued.

Another object of the present invention is to provide a method of supplying binding materials into cracks and the like of concrete with a shorter operation time and yet enabling the binding material to be fully penetrated deep into the cracks.

Still another object of the invention is to provide a method of supplying binding materials into the cracks without the risk of rupturing the sealed portions or widening the cracks.

DETAILED DESCRIPTION OF THE INVENTION

Figure 1:
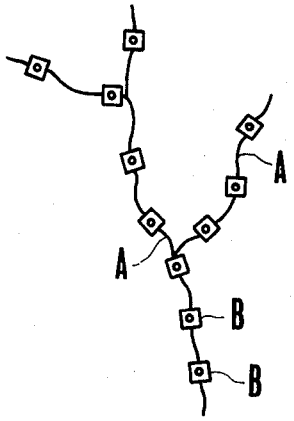
FIG. 1 is a schematic representation of the arrangement of binder supplying apparatuses in accordance with the invention along a plurality of cracks.
Figure 2:
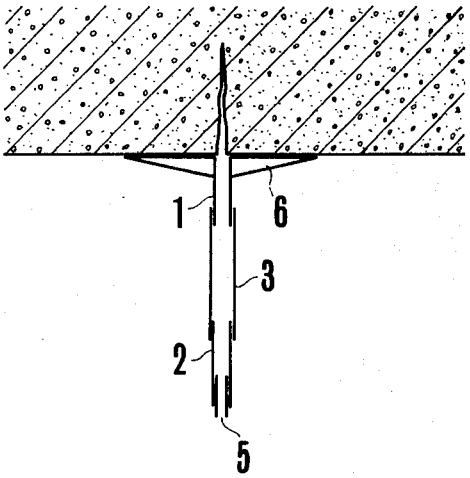
FIG. 2 is an elevation view of a pressure buffering portion, according to the invention, interconnected between supply pipes and arranged for the supply of binder to a crack within a wall.

FIG. 1 shows binder supplying apparatus B according to the invention, fixed with a sealing material as shown by FIG. 2, to cracks A on the underside, for example, of a floor of a concrete bridge, with a space of about 20 cm one from another. Said spaces between apparatuses B in the cracks are sealed with a sealing material.

Preferred embodiments of the binder supplying apparatus according to the invention are illustrated by FIGS. 2 through 5, wherein supply pipes 1 and 2 are intermediated by a pressure buffering portion 3, and a washer 6 is provided at the vicinity of the free end of pipe 1.

Figure 3:
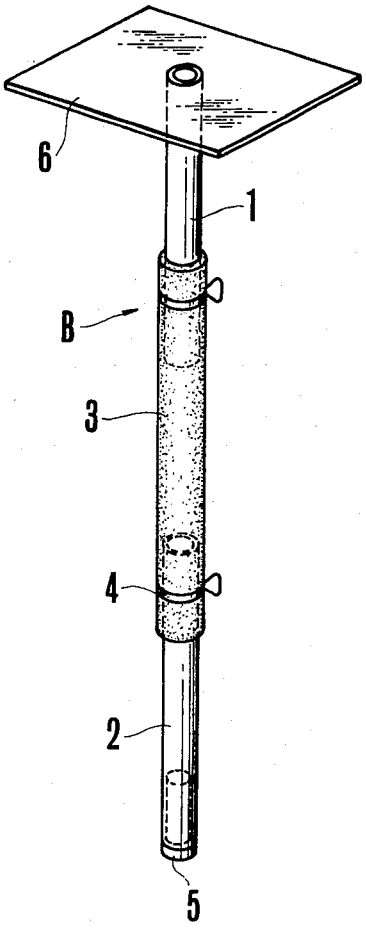
FIG. 3 is a perspective view of an apparatus according to the invention.

In FIGS. 2 and 3, a rubber tube 5 is provided at the free end of pipe 2 for facilitating the connection of a supply hose (not shown) to pipe 2. Tighteners 4 in FIG. 3 serve to secure the connection of pressure buffering portion 3 with pipes 1 and 2. In the embodiment shown in FIG. 3, pipes 1 and 2 are connected with pressure buffering portion 3 such that each end portion of pressure buffering portion 3 wraps the end portion of pipes 1 and 2 while in the embodiment shown in FIG. 4, each end portion of pressure buffering portion is wrapped by the end portion of pipes 1 and 2. Pipes 1 and 2 are made of same material, either of metallic or plastic material. Pressure buffering portion 3 is a tube made of elastic material such as rubber.

Figure 6:
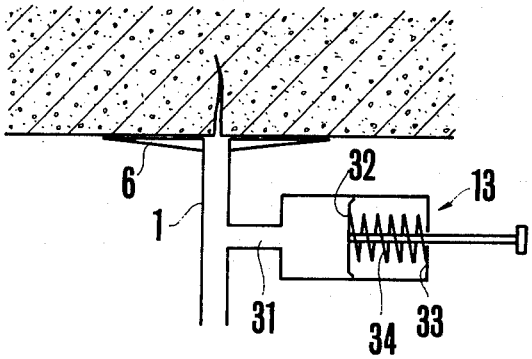
FIG. 6 is a schematic view of the arrangement of a supply pressure buffering portion in accordance with either still another embodiment of the invention.

FIG. 6 illustrates another embodiment according to the invention, wherein a pressure buffering portion consists of a housing 13 which is integrally connected to pipe 1 through duct 31 and comprises therein a partition plate 32 which sealingly reciprocates in housing 13, and a spring 34 which is located between partition plate 32 and a wall 33 opposite to duct 31 and urges on partition plate 32 when partition plate 32 is pressed by the binding material supplied. Pipe 1 may be provided with washer 6 and, pipe 2 with rubber pipe 5 if necessary.

Figure 7:
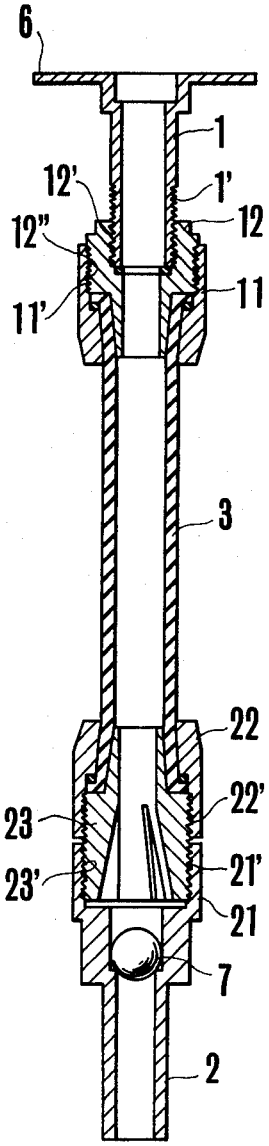
FIG. 7 is a cross-sectional view of another embodiment of the binder supplying apparatus.

FIG. 7 shows another embodiment of the binder supplying apparatus according to the invention in its cross-sectional view. In this embodiment, washer 6 is integrally formed at an end of pipe 1; the other end of pipe 1 has a thread 1'. A hollow connecting means 12 provided with a thread 12' on its inner wall and a thread 12'' on its outer wall connects pipe 1 and pressure buffering portion 3 such that connecting means 12 is screwed onto pipe 1, engaging thread 12' of connecting means 12 with thread 1' of pipe 1 while the free end of connecting means 12 is inserted into an end portion of pressure buffering portion 3. The fastening of pipe 1 to pressure buffering portion 3 is secured by screwing a hollow fixing means 11 having a thread 11' on its inner wall onto connecting means 12, engaging thread 11' of fixing means 11 with thread 12'' of connecting means 12. Pressure buffering portion 3 and pipe 2 are connected such that a hollow connecting means 23 provided with a thread 23' on its outer wall is inserted into the other end portion of pressure buffering portion 3 while a connecting means 21, hvaing a thread 21' on its inner wall and integrally formed at an end of pipe 2, is screwed onto connecting means 23, engaging thread 21' of connecting means 21 with thread 23' of connecting means 23. The fastening of pressure buffering portion 3 to pipe 2 is secured by screwing a hollow fixing means 22 provided with a thread 22' on its inner wall onto connecting means 23, engaging thread 22' of fixing means 22 with thread 23' of connecting means 23. A check valve 7 is provided to prevent the binding material supplied from flowing backwards.

A binder supplying apparatus is fixed at cracks and the like with the aid of a washer but alternatively may be fixed without a washer.

Figure 4:
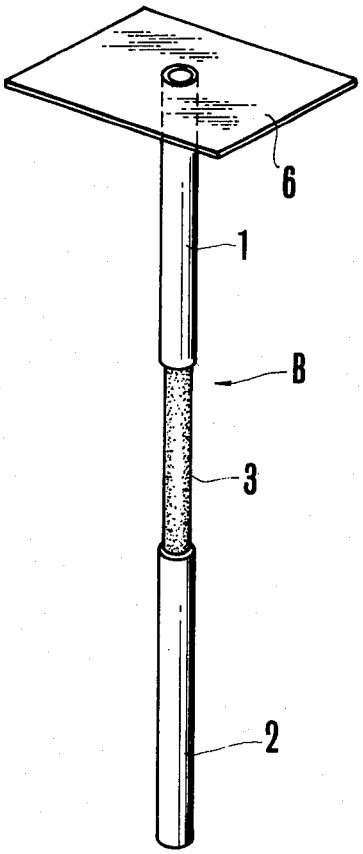
FIG. 4 is a perspective view of another embodiment of an apparatus according to the invention.
Figure 5:
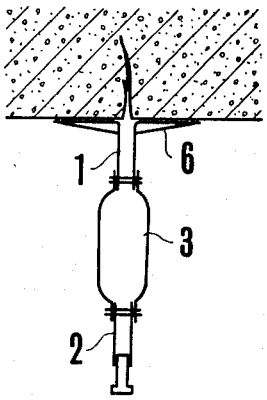
FIG. 5 is a schematic view of an apparatus according to the invention in which the supply pressure buffering portion is in an expanded state.

With the binder supplying apparatus as shown by FIG. 3 or 4, applied to cracks A of a concrete building or construction in a manner as shown by FIG. 1, and rubber tube 5 communicated with a binder supply pump (not shown) through a supply hose, a binding material, such as epoxy resin, unsaturated polyester resin, etc., is supplied into cracks A. The binding material, while being pressed into cracks A, fills the pressure buffering portions rubber tube 3, as well. When the pressure in cracks A rises to a certain level, rubber tube 3 increases in volume as shown in FIG. 5, to buffer the pressure in cracks A. Upon supplying an adequate amount of binding material using an apparatus, either tube 3 or tube 5 is closed at its end portion nearer the pump, and the supply hose is detached from the apparatus to be connected to another binder supplying apparatus and thus the operation proceeds. Even after the pump has been disconnected from the binder supplying apparatus, the binder supplying operation is continued as rubber tube 3 presses the binding material deep into cracks A by its continuous contraction till the binding material gels to finally lose its fluidity.

Thus, the time required for binder supplying operation using a binder supplying apparatus is greatly reduced owing to rubber tube 3 which buffers the supply pressure and also succeeds in binder supplying operation by its contraction.

An embodiment of the binder supplying apparatus according to the invention illustrated by FIG. 6 has a housing 13 as pressure buffering portion. A binding material, while being pressed into cracks A, fills a compartment of housing 13 as well, causing it to increase its capacity, i.e. when the pressure exerted to cracks A rises to a certain level, the binding material pushes partition plate 32 opposed by spring 34, the pressure in cracks A being thereby buffered. Upon supplying an adequate amount of the binding material through a binder supplying apparatus, rubber tube 5, for example, is closed as in the case of the embodiments previously mentioned, by its end portion nearer the pump, the binder supplying operation being succeeded by partition plate 32 which, urged by spring 34, forces the binding material deep into cracks A.

The present invention thus makes it possible to supply a binding material into cracks and the like of buildings or constructions made of concrete without rupturing the sealed portions or widening the cracks by increasing the supply rate owing to the supply pressure buffering function performed by the pressure buffering portion.

The present invention also makes it possible to fully supply the cracks with a binding material as the binding material reserved in the pressure buffering portion is continuously forced into the cracks by the continuous reduction in capacity of the pressure buffering portion.

Hence, the time required for binder supplying operation is considerably reduced according to the invention.

Further, a supply pump to be used with the present invention can be selected from a wide variation of pumps such as plunger pumps, gear pumps, grease pumps, etc. The pulsations of the binding material supplied from a pump of plunger type can be buffered according to the invention.

The present invention, in addition to its application to reparation of concrete-made buildings or constructions impaired with cracks and the like, may be used in various ways such as for sticking a steel plate onto a construction for reinforcement, filling openings of a building with fillers, etc. so long as the buildings or constructions are made of concrete.

We claim:

1. A method of filling a crack in concrete by supplying a binder under pressure from a binder supply source into the crack, comprising the steps of providing a pressure buffering portion intermediate the binder supply source and the crack for passing the binder from the binder supply source to the crack, the buffering portion having an elastic tube, an end pipe connected to one end of the elastic tube and a flat washer at an end of the end pipe, engaging the washer over and around the crack with the end pipe end over the crack, providing a supply pipe between the supply source and an opposite end portion of the elastic tube with means for connecting the elastic tube and the supply pipe, and providing check valve means for preventing the binder supplied from flowing backwards out of the elastic tube, buffering the binder supply pressure exerted on the crack by increasing the capacity of the elastic tube, storing a reserve of the binder in the elastic tube, and supplying the crack with the binder by the continuous reduction and capacity of the elastic tube so that the crack does not increase in size.

2. A method of filling a crack in concrete by supplying a binder under pressure from a binder supply source into the crack, comprising the steps of providing a pressure buffering portion intermediate the binder supply source and the crack for passing the binder from the binder supply source to the crack, the buffering portion having an elastic tube, an end pipe connected to one end of the elastic tube, engaging the end pipe over the crack with the end pipe end over the crack, providing a supply pipe between the supply source and an opposite end portion of the elastic tube with means for connecting the elastic tube and the supply pipe, and providing check valve means for preventing the binder supplied from flowing backwards out of the elastic tube, buffering the binder supply pressure exerted on the crack by increasing the capacity of the elastic tube, storing a reserve of the binder in the elastic tube, and supplying the crack with the binder by the continuous reduction and capacity of the elastic tube so that the crack does not increase in size.

* * * * *